US005195689A

United States Patent [19]

Beer et al.

[11] Patent Number: 5,195,689

[45] Date of Patent: Mar. 23, 1993

[54] MOISTURE PROOF BINDING TAPE CARTRIDGE

[75] Inventors: Ted A. Beer, Webster; Paul N. Richards, Fairport; David P. Van Bortel, Walworth, all of N.Y.

[73] Assignee: Xerox Corporation, Stamford, Conn.

[21] Appl. No.: 538,615

[22] Filed: Jun. 15, 1990

[51] Int. Cl.[5] ..... B65H 19/00

[52] U.S. Cl. ..... 242/55.53

[58] Field of Search ..... 206/225, 389, 408, 410; 242/55.53, 197

[56] References Cited

U.S. PATENT DOCUMENTS

| | | | |
|---|---|---|---|
| 1,739,549 | 12/1929 | Harris | 206/408 |
| 1,848,859 | 3/1932 | Wishart | 242/55.53 |
| 3,603,528 | 9/1971 | Kingsley et al. | 242/197 |
| 3,902,646 | 9/1975 | Kuhns | 226/90 |
| 4,101,026 | 7/1978 | Bonk | 206/389 X |
| 4,248,512 | 2/1981 | Robbins | 242/197 X |
| 4,852,732 | 8/1989 | Wilski et al. | 206/389 X |
| 4,865,196 | 9/1989 | Buelens et al. | 206/389 X |
| 4,913,368 | 3/1990 | Atkinson | 242/197 X |
| 4,953,739 | 9/1990 | Wooge et al. | 220/93 |

FOREIGN PATENT DOCUMENTS

| | | | |
|---|---|---|---|
| 0294474 | 11/1989 | Japan | 206/410 |
| 871592 | 6/1961 | United Kingdom | 206/410 |

*Primary Examiner*—Joseph J. Hail, III
*Assistant Examiner*—John P. Darling
*Attorney, Agent, or Firm*—H. Fleischer; J. E. Beck; R. Zibelli

[57] ABSTRACT

A binding tape cartridge in which a reel of binding tape is packaged in a moisture impervious bag. The bag has an exit port through which the tape is advanced. A seal, mounted in the exit port, permits the passage of tape therethrough while maintaining the interior substantially dry. This projects the binding tape from moisture, reducing the possibility of tape delamination.

10 Claims, 7 Drawing Sheets

MOISTURE PROOF BINDING TAPE CARTRIDGE

This invention relates generally to binding tape used in an electrophotographic printing machine, and more particularly concerns a binding tape cartridge for maintaining the binding tape substantially moisture free.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material int contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a high speed commercial printing system of the foregoing type, the copy sheets with the information permanently affixed thereto, are transported to a finishing station. After the requisite number of sheets, corresponding to a set of original documents, is compiled in the finishing station, the copies of the set are permanently affixed to one another to form a booklet thereof. Most frequently, a stapling apparatus is employed to secure the sheet to one another to form the booklet. However, other alternative techniques have been used such as adhesively binding the sheets to one another. In order for each set of copy sheets to have a bound finished appearance, it is desirable to adhesively secure the sheets of the set to one another. Often, the printing machine employs a recirculating document handling system to advance successive original documents form a stack thereof to the exposure station of the electrophotographic printing machine for reproduction. When a recirculating document handling system is employed, the printing system produces a large number of copies rapidly. This type of system may be used to form sets or booklets of copy sheets. The copy sheets are collected and adhesive is applied to the spine to bind the sheets together into sets of copy sheets. The adhesively bound sets of copy sheets are then stacked for presentation to the machine operator. Numerous methods are known in the art for adhesively securing sheets to one another. For example, a liquid adhesive may be applied to the spine of a moving set of copy sheets, or the copy sheets may be stationary and a container having a supply of adhesive therein may be moved along the spine to apply the adhesive thereon. Alternatively, a tape having an adhesive on one surface thereof may be positioned in contact with the spine and heat applied thereto so as to cause the adhesive to flow between the sheets in the region of the spine securing the sheets together. In order to maintain the printing machine operating at high efficiency with minimum loss of productivity, it is necessary to supply a large volume of binding tape. In order to optimize storage of a supply of binding tape, the binding tape is stored on a reel. A typical binding tape is a four layer composite of paper, aluminum foil, flap adhesive, and spine adhesive. Except for the aluminum layer, all of the layers are hygroscopic, i.e., they readily absorb water. The paper and the spine adhesive, which is made from a polyamide, absorb the greatest amount of water within the composite. During the binding process, heat and pressure are applied to the binding tape raising the tape to a temperature in excess of 300° F. The water absorbed in the tape layers is vaporized and creates high pressures between the composite layers. This pressure may be sufficient to cause delamination of the adhesive and base paper resulting in failure of the bind. Various types of cartridges have been used for storing binding tape. The following disclosure appears to be relevant:

U.S. Pat. No. 3,902,646

Patentee: Kuhns

Issued: Sep. 2, 1975

The relevant portions of the foregoing patents may be summarized as follows:

U.S. Pat. No. 3,902,646 discloses an automatic strip inserter for binding a stack of sheets which has a mechanism for feeding a strip from a cartridge and cutting the strip to the required length. Cartridges having different width binding tapes may be used.

In accordance with one aspect of the present invention, there is provided a binding tape cartridge, including means for storing a supply of binding tape. Means, substantially impervious to moisture, enclose the storing means. The enclosing means has an exit port through which binding tape advances. Means, substantially impervious to moisture, seal the exit port in the enclosing means while being pervious to tape advancing through the exit port in the enclosure. In this way, the tape in the enclosure is maintained substantially dry and does not absorb moisture.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
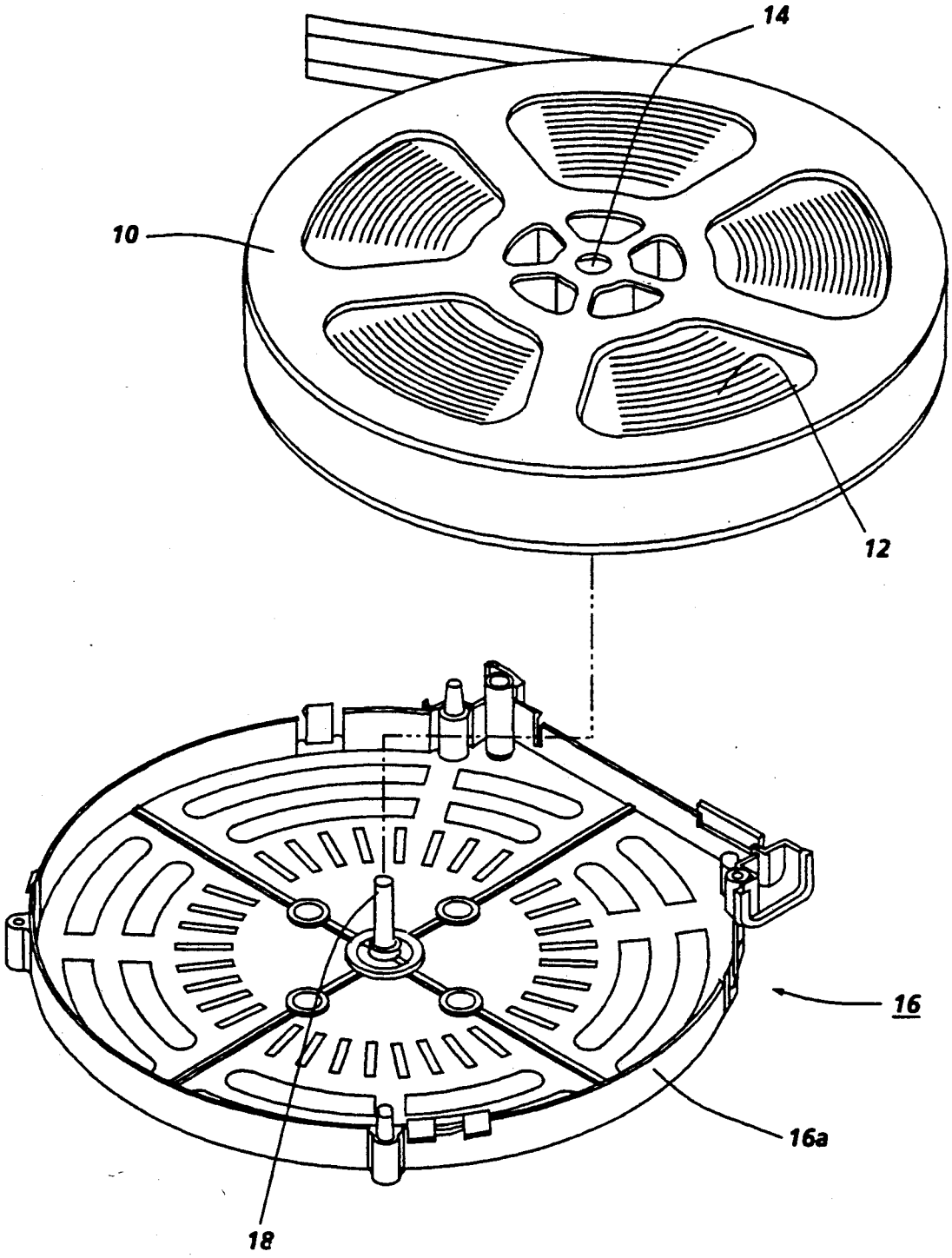
FIG. 1 is an exploded perspective view depicting a binding tape reel being mounted in lower portion of a housing.

For a general understanding of the features of the present invention, reference is made to the drawings. In the drawings, like reference numerals have been used throughout to identify identical elements. FIG. 1 shows a binding tape reel 10 having binding tape 12 wound about hub 14. Reel 10 is shown being mounted in lower portion 16*a* of binding housing 16. Hub 14 is mounted on spindle 18 which extends upwardly from lower portion 16*a* of housing 16. After reel 10 is mounted on spindle 18 of lower portion 16*a* of housing 16, upper portion 16*b* (FIG. 2) of housing 16 is mounted thereon to enclose reel 10.

Figure 2:
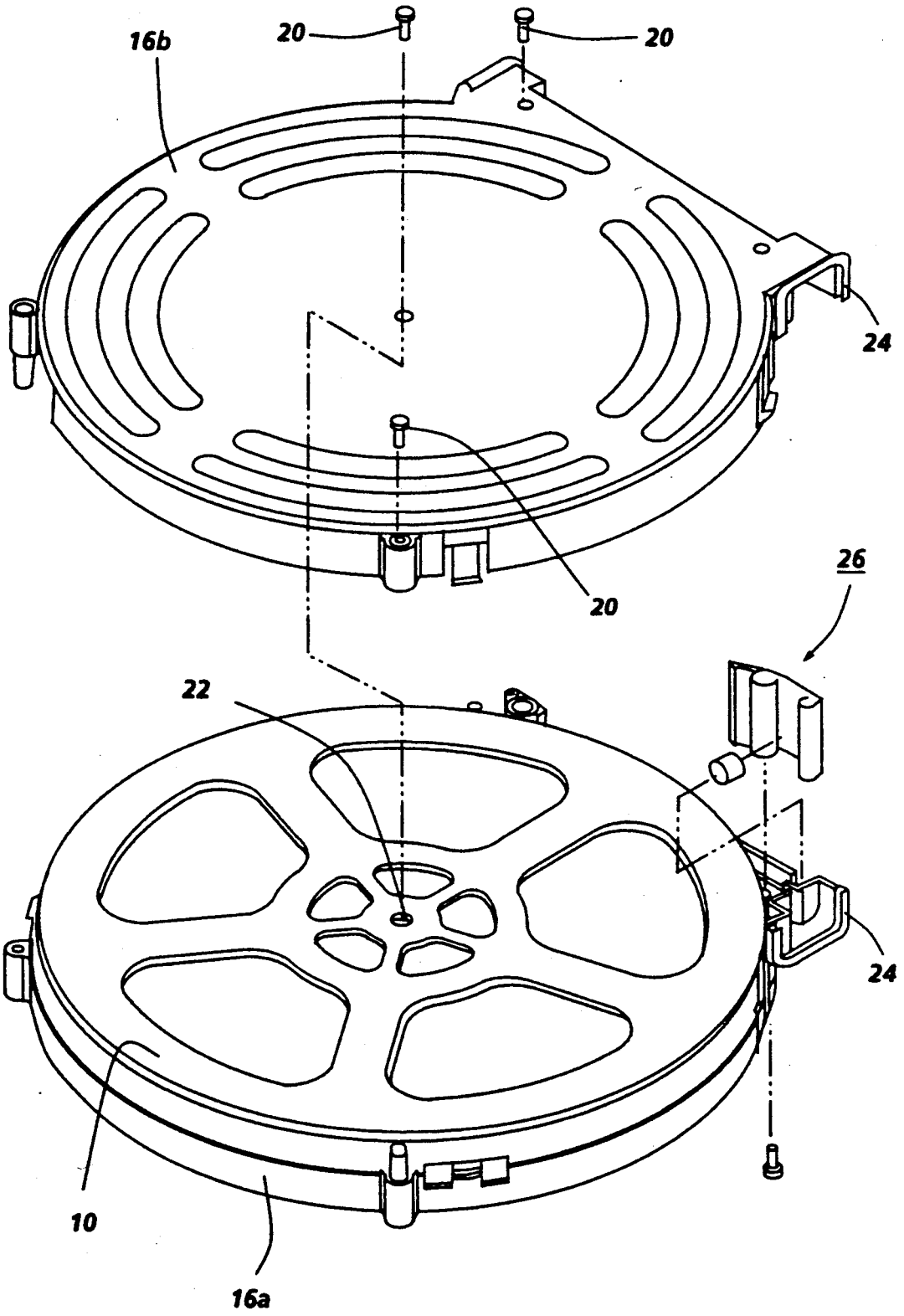
FIG. 2 is an exploded perspective view showing the upper portion of the housing being mounted over the binding tape reel.

Referring now to FIG. 2, there is shown upper portion 16*b* of housing 16 being mounted on lower portion 16*a* after reel 10 is mounted therein. As shown thereat, upper portion 16*b* of housing 16 is secured by self tapping screws 20 to lower portion 16*a* and through hole 22 into the upper surface of spindle 18 of lower portion 16*a*. A frame formed by the upper and lower portions of housing 16, indicated generally by the reference numeral 24, provides a support for the exit port seal and a guide for the exiting binding tape. Tape reel brake 26 is mounted in the open end of frame 24.

Figure 3:
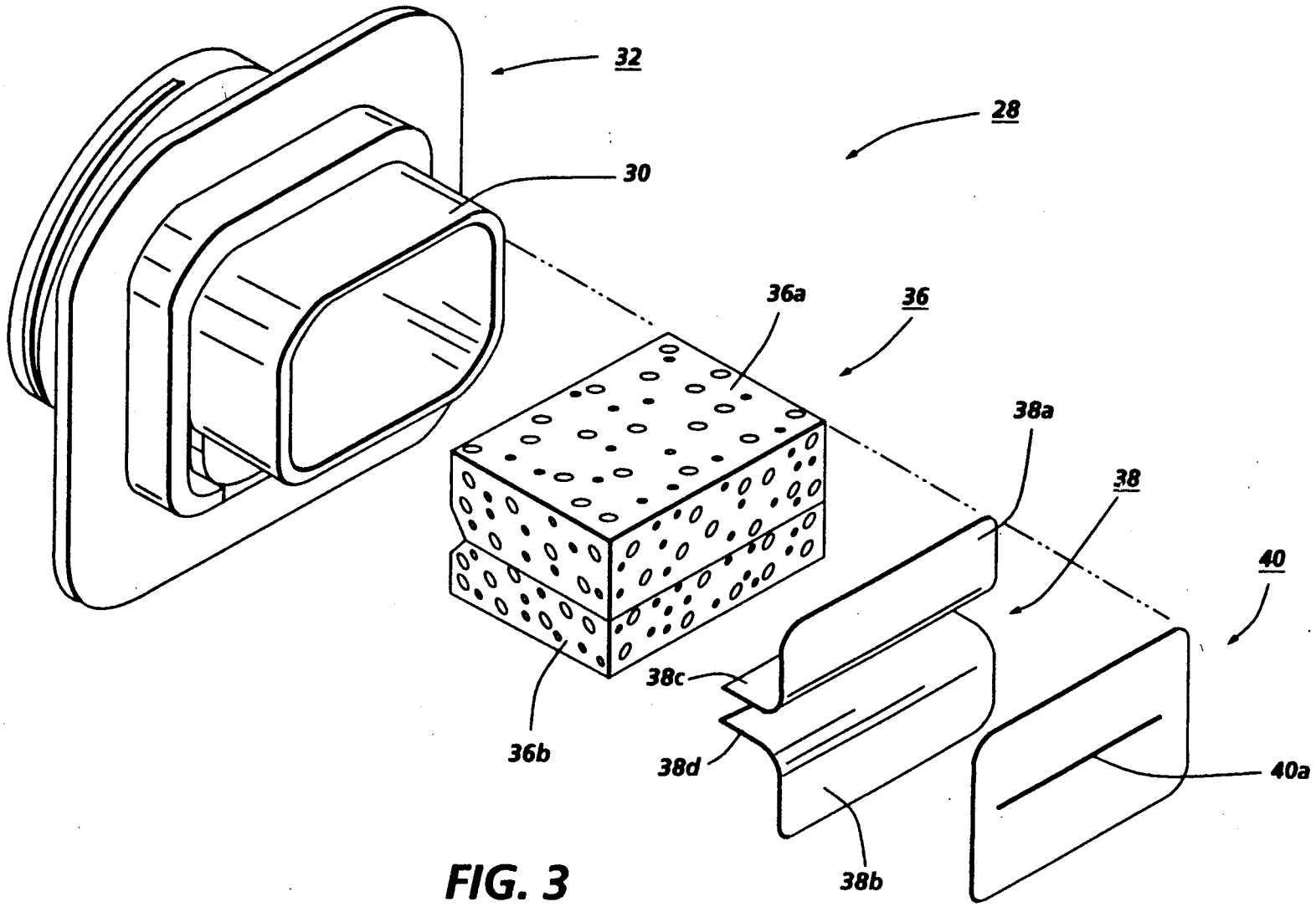
FIG. 3 is an exploded perspective view illustrating the exit port seal.
Figure 4:
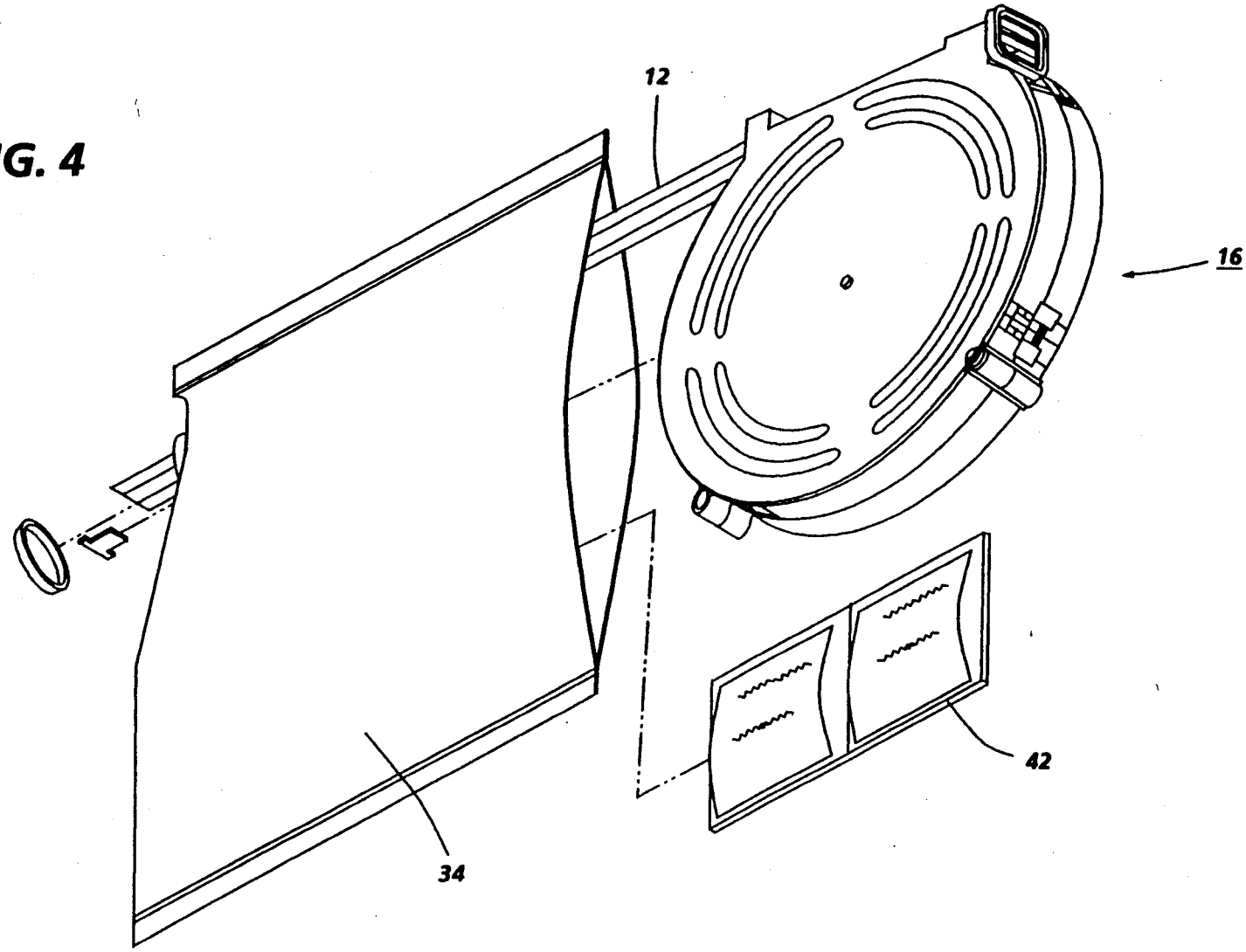
FIG. 4 is an exploded perspective view of the binding tape housing being placed in a moisture proof bag.

Turning now to FIG. 3, there is shown the exit port seal, indicated generally by the reference numeral 28. Exit port seal 28 includes a conduit 30 having a flange 32 extending outwardly therefrom. Conduit 30 is adapted to be mounted in frame 24 with flange 32 engaging the exterior surface of a moisture impervious bag 34 (FIG. 4). A split foam member is mounted in conduit 30. The binding tape is sandwiched between the upper portion 36*a* and lower portion 36*b* of foam member 36. Preferably, foam member 36 is made from a low density, low ga permeable polyurethane material. Tape guide 38 has an upper portion 38*a* and a lower portion 38*b*. Lip 38*c* of upper portion 38*a* is interposed between upper portion 36*a* and lower portion 36*b* of foam member 36. Similarly, lip 38*d* of lower portion 38*b* is interposed between upper portion 36*a* and lower portion 36*b* of foam member 36 to define a tape entrance zone. Finally, end cap 40 is mounted on upper portion 38*a* and lower portion 38*b* of tape guide 38 with slit 40*a* being substantially aligned with the tape entrance zone. In this way, the binding tape advances through slit 40*a* of end cap 40 between upper portion 38*a* and lower portion 38*b* of tape guide 38. Tape guide 38 guides the advancing tape between upper portion 36*a* and lower portion 36*b* of foam member 36 as it exits bag 34. An exit port seal of this type prevents moisture from being absorbed into bag 34 as the binding tape exits the bag.

Figure 5:
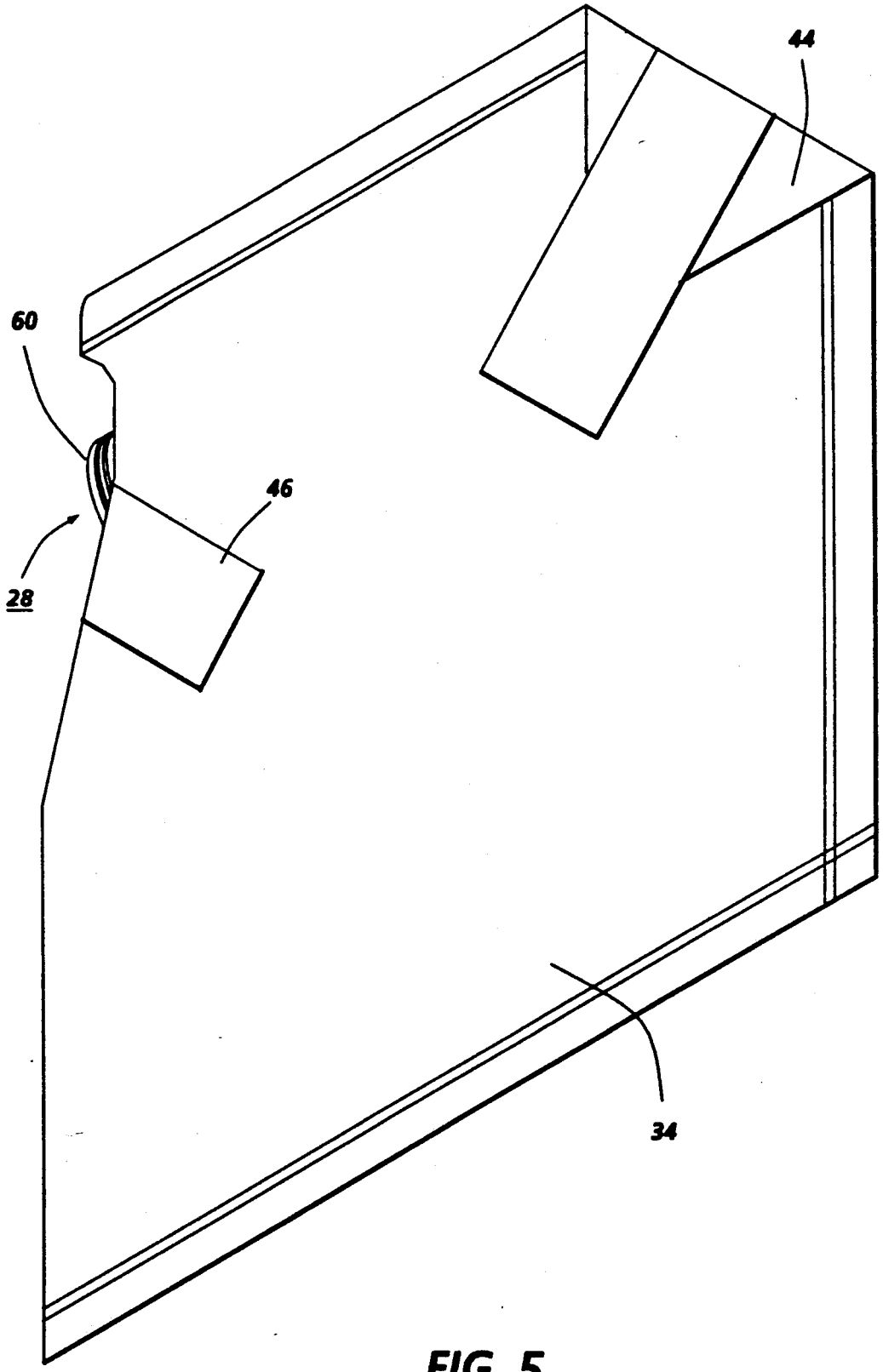
FIG. 5 is a perspective view showing the binding tape housing in the FIG. 4 moisture proof bag.
Figure 6:
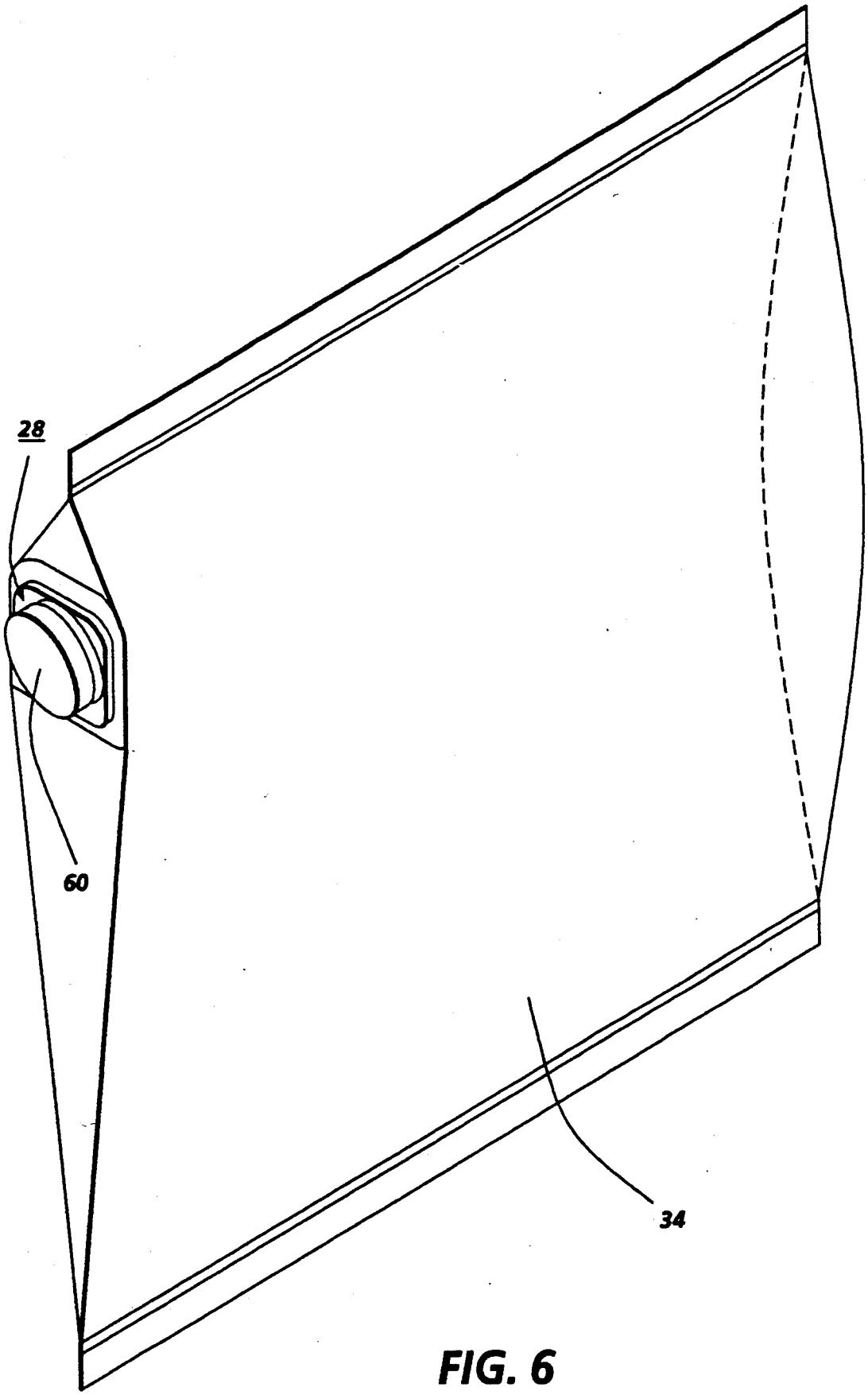
FIG. 6 is a perspective view showing the binding tape housing being sealed in the FIG. 4 moisture proof bag.

FIG. 4 illustrates bag 34 being place about housing 16 having reel 10 therein. A portion of the binding tape 12 is shown advanced from housing 16. A desiccant 42 is placed inside bag 34 to absorb moisture. Bag 34 is made from a metalized, polyester material having exit port seal 28 heat sealed thereto. The open ends of bag 34 are heat sealed. A heat sealed bag having the binding tape housing disposed therein is shown in FIGS. 5 and 6. As illustrated in FIG. 5, free ends 44 and 46 of bag 34 may be folded over and taped in place. Heat seals are formed on the edges of the bag with exit port seal 28 being heat sealed to bag 34. When the sealed bag is stored on a shelf, a cap 60 is in threaded engagement with the exit port seal 28, i.e. cap 60 is screwed onto the threaded, open end of conduit 30. In this way, the bag is impervious to moisture with any residual moisture being absorbed by the desiccants placed therein during the sealing process.

Figure 7:
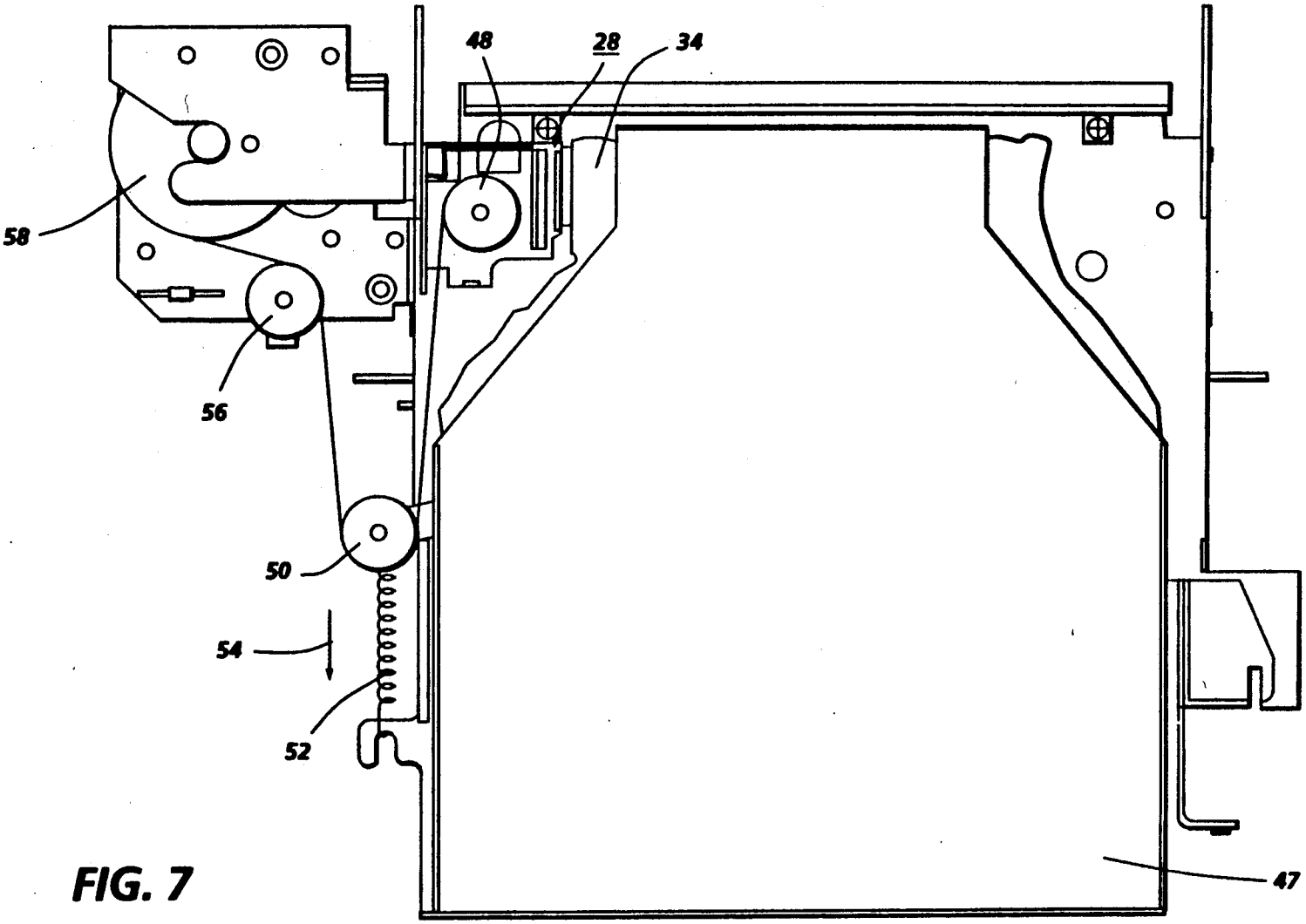
FIG. 7 is an elevational view showing the moisture proof bag with the binding tape in the cartridge mounted in the binding mechanism.

Referring now to FIG. 7, there is shown bag 34 with binding tape housing 16 positioned in the cartridge housing 47 and mounted in the binding mechanism. At this time, the internal brake mechanism is inactivated. The binding tape advances from reel 10 in housing 16 through exit port seal 28 in bag 34 over roll 48. After passing over roll 48, binding tape 12 passes beneath roll 50. Spring 52 resiliently urges roll 50 in the direction of arrow 54 to maintain tape 12 under tension. The tape is then advanced over roll 56 and beneath roll 58 for injection into the binding apparatus of the printing machine when cartridge 48 is mounted therein. In this way, the operator may readily load the cartridge into the printing machine binding apparatus. During shelve storage, the binding tape is maintained substantially dry so that the tape does not delaminate during the binding operation. Typically, the cartridge has a supply of binding tape sufficient for about 450 binds suing a tape of 11 inches in length.

In recapitulation, the binding tape cartridge of the present invention houses a supply of binding tape in a moisture impervious bag. The tape is advanced through an exit port form the housing in the bag to the binding apparatus in the printing machine. The exit port is sealed with a moisture impervious seal. The exit seal permits the tape to advance through the exit port while preventing moisture form entering the bag. In this way, the binding tape stored in the bag is maintained dry.

It is, therefore, evident that there has been provided, in accordance with the present invention, a binding tape cartridge that fully satisfies the aims and advantages hereinbefore set forth. While this invention has been describe din conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. A binding tape cartridge, including:

means for storing a supply of binding tape;

means, substantially impervious to moisture, for enclosing said storing means, said enclosing means being attached to said storing means and having an exit port through which binding tape advances; and means, substantially impervious to moisture, for sealing the exit port in said enclosing means while being pervious to tape advancing through the exit port in said enclosing means so that the tape in said enclosing means is maintained substantially dry and does not absorb moisture.

2. A cartridge according to claim 1, further including means for maintaining the tape advancing through the exit port in said enclosing means under tension.

3. A cartridge according to claim 2, further including means, disposed in said enclosing means, for absorbing moisture.

4. A cartridge according to claim 3, wherein said sealing means is mounted at the exit port on said enclosing means.

5. A cartridge according to claim 4, wherein said storing means includes:

a housing; and a reel, mounted rotatably in said housing and having the supply of binding tape mounted thereon.

6. A cartridge according to claim 5, wherein said sealing means includes:

a frame mounted at the exit port on said enclosing means; and a resilient member mounted in the frame and having a slit therein with opposing sides of the slit pressing into contact with one another and the binding tape being adapted to advance through the slit in said resilient member.

7. A cartridge according to claim 6, wherein said resilient member is made form a urethane material.

8. A cartridge according to claim 7, wherein said enclosing means includes a flexible bag.

9. A cartridge according to claim 8, wherein said flexible bag is made from a polyester material having a metal coating thereon.

10. A cartridge according to claim 8, wherein said frame is heat sealed to said flexible bag at the exit port therein.

* * * * *